US008328317B1

(12) United States Patent
Yee

(10) Patent No.: US 8,328,317 B1
(45) Date of Patent: Dec. 11, 2012

(54) SELF-ERASING PRINTING SYSTEM

(76) Inventor: Carl Yee, San Diego, CA (US)

( * ) Notice: Subject to any disclaimer, the term of this patent is extended or adjusted under 35 U.S.C. 154(b) by 437 days.

(21) Appl. No.: 12/502,972

(22) Filed: Jul. 14, 2009

(51) Int. Cl.
*B41J 29/38* (2006.01)
*B41J 2/17* (2006.01)

(52) U.S. Cl. ..... 347/16; 347/95

(58) Field of Classification Search ..... 347/6–7, 347/16, 19, 95–96
See application file for complete search history.

(56) References Cited

U.S. PATENT DOCUMENTS 4,171,982 A * 10/1979 Lin ..... 106/31.21
5,943,067 A 8/1999 Kong
7,111,933 B2 9/2006 Morris
7,205,088 B2 4/2007 Iftime
7,381,757 B2 6/2008 Sato
7,571,969 B2 * 8/2009 Kusunoki et al. ..... 347/9
2004/0150702 A1 8/2004 Tsuyoshi
2007/0159517 A1 * 7/2007 Hashimoto et al. ..... 347/100
2007/0228005 A1 10/2007 Hasegawa
2009/0034997 A1 2/2009 Edwards
2009/0295851 A1 * 12/2009 Edwards et al. ..... 347/9

OTHER PUBLICATIONS

User "Globaltourniquet" at Halfbakery.com, "Disappearing Toner-Disappearing ink for your printer", posted to www.halfbakery.com/idea/Disappearing_20Toner on May 25, 2002.
Masino, "Disappearing Ink Inkjet Cartridge", posted to www.masino.com/ideas/DisappearingInkjet.php, circa 2001.

* cited by examiner

*Primary Examiner* — Jason Uhlenhake

(57) ABSTRACT

In accordance with one embodiment a self-erasing printing system comprises a substrate such as paper, a printer, a printer driver, and self-erasing ink. The self-erasing ink can comprise an acid-base indicator and a base whereby the ink is colored when printed but erases itself after a predetermined period of time. After the ink has self-erased the substrate may be reused.

8 Claims, No Drawings

SELF-ERASING PRINTING SYSTEM

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This application relates to ink-jet printing, more particularly involving print media reuse.

2. Prior Art

The following is a list of some prior art that presently appears relevant:

U.S. PATENTS

| Pat. No. | Issue Date | Name of Patentee |
|---|---|---|
| 5943067 | Aug. 24, 1999 | Kong |
| 7205088 | Apr. 17, 2007 | Iftime |
| 7381757 | Jun. 03, 2008 | Sato |
| 7111933 | Sep. 26, 2006 | Morris |

U.S. PATENT APPLICATIONS

| Publication Number | Publication Date | Name of Applicant |
|---|---|---|
| 20040150702 | Aug. 05, 2004 | Tsuyoshi |
| 20090034997 | Feb. 05, 2009 | Edwards |
| 20070228005 | Oct. 04, 2007 | Hasegawa |

NON-PATENT LITERATURE DOCUMENTS

User "GLOBALTOURNIQUET"at Halfbakery.com, "Disappearing Toner - Disappearing ink for your printer", posted to www.halfbakery.com/idea/Disappearing_20Toner on May 25, 2002

MASINO, "Disappearing Ink Inkjet Cartridge", posted to www.masino.com/ideas/DisappearingInkjet.php, circa 2001

Despite the availability of electronic information displays, the consumption of paper for printing hardcopies continues to increase. Although paper is inexpensive, the quantity of new paper that is used and discarded is enormous and the impact on the environment is significant. Some of the discarded paper is recycled. While an improvement over disposal, recycling nevertheless requires collection, transportation and processing, with associated economic and environmental costs.

A large amount of paper is consumed printing permanent hardcopies in situations where a temporary hardcopy would suffice. Frequently a temporary hardcopy would be adequate for a meeting agenda, a draft of an article, memorandum, or report to be proofread, or recurring information such as daily as schedules or news. It is often helpful to have hardcopy in hand to read but a permanent hardcopy copy of the information is not required. For this reason many paper documents are discarded the same day they are printed.

Several alternative types of print media have been developed to substitute for paper in temporary hardcopies. These media are designed to be erased and reused multiple times. U.S. Pat. No. 5,943,067 to Kong discloses a multi layer print medium that is electrically, magnetically, thermally or similarly activated by a physical effect to change its appearance. U.S. Pat. No. 7,205,088 to Iftime discloses a print medium that changes appearance when exposed to a particular wavelength of light. Similarly U.S. patent application 20090034997 to Edwards discloses a print medium that changes appearance when exposed to light or heat. The substitute print media of Kong, of Iftime, and of Edwards are more costly than paper, are not recyclable at the end of their useful life, and require the purchase and use of special new printing equipment. In addition, erasing devices are typically required to allow reuse of the media.

Another approach has been to develop erasable inks and corresponding erasing devices and procedures to allow the reuse of paper from temporary hardcopies. U.S. Pat. No. 7,381,757 to Sato discloses ink which is visible when printed and erased when the paper is heated. A heating device or procedure is required to erase the ink from the paper before the paper can be reused. U.S. patent application 20040150702 to Tsuyoshi discloses ink which is visible when printed and erased when the paper is illuminated. An illumination device or procedure to un-stack pages of a document and expose each and every sheet to light is required to erase the ink from the paper before the paper can be reused. U.S patent application 20070228005 to Hasegawa discloses a process to apply a special coating to paper, print on the coated paper, and then erase the paper using a reactive gas generated by a creeping discharge or corona discharge machine.

U.S. Pat. No. 7,111,933 to Morris discloses a system in which invisible ink is printed on a substrate and subsequently made visible by a developer. The disclosed process is the opposite of self-erasing and does not address temporary hardcopies.

Writing pens are available that contain disappearing ink. These are made for humor and entertainment rather than for the reuse of paper. On the Internet, suggestions have been made somewhat facetiously to extend the disappearing ink pen concept to printers. A posting by the user name "GLOBALTOURNIQUET" at www.halfbakery.com/idea/Disappearing_20 Toner asks if disappearing ink is available to hide the evidence that an obscene e-mail message was printed. A posting by Masino at www.masino.com/ideas/DisappearingInkjet.php suggests that a disappearing ink inkjet cartridge would be useful to print disappearing clauses on contracts, or clothing on pornographic images to avoid getting into trouble at work.

From consideration of the foregoing there remains a need to provide a means of printing temporary hardcopies that are familiar in appearance and handling, inexpensive, self-erasing, reusable, and recyclable. There is further need to produce the temporary hardcopies using existing printing equipment.

SUMMARY

In accordance with one embodiment a self-erasing printing system comprises a substrate such as paper, a printer, a printer driver, and an ink which is self-erasing.

DETAILED DESCRIPTION

It is to be understood that the scope of the embodiments is not limited to the particular systems, methods, compositions, and materials which are disclosed herein because such may vary. It should also be understood that all terminology used herein is only for the purpose of describing particular embodiments. These terms are not intended to be limiting in any way and should not be misconstrued to limit scope.

As used herein, the term "paper" refers to any printable substrate. The term may refer not only to paper but also to cloth and woven or non-woven textiles, plastics, polymers, metals, and any other material or media capable of receiving a printed image.

As used herein, the term "printer" refers to a device that reproduces information on paper using a liquid ink. Examples can include ink-jet printers, bubble-jet printers, copiers, facsimile machines, receipt printers, ticket validators, plotters, and the like.

As used herein, the term "image" refers to marks, signs, symbols, figures, indications, and/or appearances than can be printed. Examples of images can include characters, words, numbers, alpha-numeric symbols, punctuation, text, lines, underlines, highlighting, pictures, graphics and the like.

As used herein, the term "invisible" means not able to be seen readily with the naked eye. This does not mean completely imperceptible. An observer may see that an image is present but the image is still considered "invisible" if it does not appear substantially different from the background or is not readily discernable.

As used herein, the term "self-erasing" refers to the ability of an image to become invisible without the application of external stimuli. The presence of air and the passage of time are not considered external stimuli. Examples of external stimuli can include light, heat, cold, radiation, humidity, desiccation, mechanical forces and manipulation, gasses, chemicals, absence of light, absence of air, and the like.

As used herein, the term "reuse" means to use again, for the same purpose or for a different purpose.

As used herein, the term "recycle" means to break down and then reprocess waste material for a useful purpose.

With this in mind, systems and methods of printing self-erasing temporary hardcopies are described. A self-erasing printing system may include paper, a printer, a printer driver, and self-erasing ink. In one embodiment the printer, under control of the printer driver, forms images by applying self-erasing ink to the paper.

In an alternative embodiment, a method of temporary printing can comprise steps of setting up a printer, printing temporary hardcopies, reading or otherwise using the temporary hardcopies, erasing the images from the hardcopy paper, and reusing the paper. In another aspect of this method the paper may be recycled or discarded at the end of its useful life.

Regarding setting up a printer, one step can include ink selection. The printer may contain only a single cartridge of self-erasing ink or it may contain multiple cartridges of different types of ink. Multiple cartridges may include different formulations of self-erasing ink which self-erase over shorter or longer durations. Multiple cartridges may include different colors of self-erasing ink as well as different colors of conventional permanent ink or other inks.

The printer driver is computer code that formats data to print properly on a particular printer and allows specification of the qualities, characteristics, or attributes of the printed images. The type or types of ink loaded in the printer may be automatically communicated to the printer driver from the cartridges containing the inks by means of codes, electronic signals, and the like. The type or types of ink may also be communicated to the printer driver by being entered manually by the user. The user may use the printer driver to select which ink or inks are to be used and assign or map different inks to different colors in the image to be printed.

Another step that can be included in setting up the printer is adjustment of how fast the printed hardcopies will self-erase. In addition to different formulations of ink, the self-erasing time is also determined by the quantity of ink that is applied to the paper by the printer to form each image. If an image is printed using less self-erasing ink the image will become invisible sooner. If an image is printed using more self-erasing ink, which increases the ink saturation of the paper, the image will take longer to become invisible. This adjustment of self-erasing time by adjusting the amount of ink applied can be made using the printer driver or equivalent. It may also be adjusted by altering the properties of the electronic document to be printed. For example, text that is formatted in a "bold" font will take longer to self-erase compared to a normal black font because more ink is applied when the text is printed. Conversely text formatted in a lighter shade will self-erase more quickly than darker text because less ink will be applied.

Furthermore setting up the printer can include a step of calibration of the self-erasing time. With calibration, the printer driver can provide more accurate estimation and control of the time required for self-erasing after printing, accounting for factors such as ink formulation, environmental conditions, state of the printer, user perception of what is visible and invisible, and the particular paper that is being used. Papers which absorb and retain more ink take longer to self-erase. The calibration step may include printing sample images on a particular paper, recording the time required for the images to self-erase, and entering that time, corresponding paper type, and other relevant information into the calibration algorithm of the printer driver.

An additional step of setting up the printer may include specifying that a header, footer, watermark, or similar notification be added to the printed page indicating that the page is a temporary hardcopy. This would help prevent confusion of temporary and permanent hardcopies. The notification can also identify the particular self-erasing ink used, the time and date of printing, and estimated time and date the images will have self-erased.

After setting up the printer is complete the temporary hardcopies are printed. The printing process proceeds in the same manner as conventional printing and requires no further description.

Regarding the next step of reading or otherwise using the temporary hardcopies, there is again little difference from the manner in which conventional hardcopies are used. If the temporary hardcopy is printed using self-erasing ink in a distinctive or unusual color it will be easier to distinguish from a permanent hardcopy.

Considering that the paper is to be reused it is advisable to minimize physical damage to the paper such as wrinkling, folding, tearing, etc. Paper which has been stapled may be reused once the staples are removed. Instead of stapling, less damaging methods of collecting multiple pages together may be used. To increase the number of possible reuse cycles he paper feeding mechanism in the printer may be designed to function despite damaged paper.

In the case of editing, proof-reading or the like, the temporary hardcopy may be annotated with a pen containing self-erasing ink or by the use of notes written on temporary adhesive notes. The temporary nature of these annotations preserves the possibility of reuse of the paper.

Next the images are erased from the paper. This takes place automatically as the self-erasing ink becomes invisible over time. It may be useful to hold paper to be reused in trays or the like near the printer or place of reuse. For example one tray can contain paper that is already erased and ready for reuse, a second tray can contain paper on which the images are almost invisible, and a third tray can contain the most recently printed hardcopies which have not yet substantially self-erased.

The erasing process may be accelerated in ways determined by the chemistry of the self-erasing ink formulation. Such may include application of water, acids or concentrated carbon dioxide gas, however, none of these are necessary for the paper to self-erase.

The final step is reusing the paper. Some of the paper may have been marked with permanent ink, physically damaged, or worn out after multiple cycles of reuse. This paper which is not suitable for reuse is culled for conventional recycling or disposal. The remaining paper may be printed again to make temporary or permanent hardcopies or otherwise reused. A device to press or flatten the paper may be used to increase the proportion of paper that can be reprinted despite some folding or wrinkling.

Regarding the self-erasing printing system, the self-erasing ink may be supplied in the same forms as conventional ink. These may include pre-filled cartridges for specific printers, cartridge refill kits, and bulk containers. The available self-erasing inks may comprise inks of different colors and times required for self-erasing.

In one embodiment the self-erasing ink comprises a solvent, an acid-base indicator, a base, and a surfactant. The solvent is a liquid carrier substance in which the other substances of the ink are dissolved or dispersed. The acid-base indicator serves as the colorant or pigment of the ink. The acid-base indicator is colorless except in the presence of a base or high pH chemical. The base substance in the ink reacts with the acid-base indicator to make it colored and hence visible. The surfactant is a substance which lowers the surface tension of the ink so that it can travel through the ink cartridge and printer correctly and absorb into the paper sufficiently to form a well defined image. In addition the base and surfactant act synergistically to increase in the amount of acid-base indicator that can be dissolved by the solvent. This allows formulation of ink of sufficient color intensity to be visible after printing.

When an image is printed using the self-erasing ink, it is visible because the ink contains a base which causes the acid-base indicator to have color. The color intensity of the ink is proportional to both the concentration of the acid-base indicator in the ink and the pH or amount of base. After printing the base is neutralized over time by chemical reactions involving carbon dioxide in the atmosphere. As the ink loses its base and the pH is lowered the acid-base indicator becomes colorless and the ink self-erases. More specifically, carbon dioxide which is present in the air reacts with water in the ink and air to form carbonic acid. The carbonic acid then reacts with the base in the ink to produce other substances such as carbonates, water, and the like. As the base is consumed by these reactions the acid-base indicator becomes colorless and thus the ink becomes invisible. The evaporation of the solvent in the ink also contributes to the self-erasing.

The solvent or solvents of the self-erasing ink comprise 50% to 99% of the ink by weight. Ink with less than 50% solvent by weight may not flow through the printing mechanism and may not be absorbed into the paper sufficiently to produce a useful image. A combination of solvents may be used to optimize the overall performance of the self-erasing ink, as different solvents have different beneficial properties. Solvent selection may depend on but is not limited to factors such as compatibility with other components of the ink and printer, evaporation rate, stability and shelf-life, odor, toxicity, safety, cost, color, pH, viscosity, etc.

In one embodiment a solvent can be water. Other suitable solvents include but are not limited to ethanol, methanol, isopropanol, acetamides, acetone, acetonitrile, alcohol derivatives, aliphatic alcohols, aliphatic linear or branched or cyclic hydrocarbons, amides, amino alcohols, aromatic alcohols, aromatic hydrocarbons, benzyl alcohol, butanol, butoxy ethylene glycol, butyl carbitol, butyl cellosolve, butylene glycol, carbitol, carboxylic acids, cello solve, cyclohexanol, diethanolamine, diethylene glycols, diethylene glycol monobutyl ether, diethylene glycol monomethyl ether, diethylenetriamine, dimethyl sulfoxide, diols, dipropylene glycols, dipropylene glycol monomethyl ether, ethanolamine, ether derivatives, ethers, ethylene glycol monoethyl ether, ethylene glycol, ethylene glycol alkyl ethers, ethylene glycol diacetate, ethylene glycol monobutyl ether, ethylene glycol monoethyl ether, ethylene glycol monomethyl ether acetate, ethylene glycol monophenyl ether, ethylenediamine, formamides, glycerin, glycol butyl ethers, glycol ethers, heterocyclic hydrocarbon and halogen-containing solvents, hexanediol, hexanol, higher homologs of poly(ethylene glycol) alkyl ethers, higher homologs of poly(propylene glycol)alkyl ethers, isobutanol, ketones, lactams, long chain alcohols, methoyoxy triethylene glycol, morpholine, n-butyl alcohol, N-dimethyl acetamide, N-dimethyl formamide, N-ethyl diethanolamine, N-ethyl morpholine, N-methyl diethanolamine, N-methyl-2-pyrrolidone, N-vinyl-2-pyrrolidone, 1,2-diols of 30 carbons or less, 1,3-dimethyl-2-imidazolidinone, 1,3-diols of 30 carbons or less, 1,5-diols of 30 carbons or less, 1,5-pentanediol, 1-pentanol, 2-ethyl-2-hydroxymethyl-1-3-propanediol, 2-oxazolidone, 2-pyrrolidone, 3-dimethyl-2-imidazolidinone, 3-methoxybutanol, substituted pyrrolidones, organo sulfides, organosulfoxides, pentanediol, pentanol, poly(ethylene glycol)alkyl ethers, poly(glycol) ethers, poly(propylene glycol)alkyl ethers, polyethylene glycols, polyethylene-imine, polyhydric alcohols, polypropylene glycols, primary aliphatic alcohols of 30 carbons or less, primary aromatic alcohols of 30 carbons or less, propanol, propylene glycols, propylene glycol alkyl ethers, propylene glycol monobutyl ether, propylene glycol monomethyl ether, sec-butanol, secondary aliphatic alcohols of 30 carbons or less, secondary aromatic alcohols of 30 carbons or less, substituted acetamides, substituted formamides, sulfolane, sulfones, t-butanol, tetramethyl propylene diamine, thiodiglycol, triethanol amine, triethylene glycol, triethylene glycol monoethyl ether, triethylene glycol monomethyl ether, triethylene glycols, triethylenetetramine, and the like.

The acid-base indicator or indicators which give the self-erasing ink color comprise 0.1% to 15% of the ink by weight. Ink with less than 0.1% indicator by weight may lack sufficient color intensity to produce a visible image. Ink with over 15% indicator by weight is likely to have particles of the indicator that remain undissolved in the solvent which can clog the printing mechanism. The amount of acid-base indicator in the ink also depends on the properties of the indicator that is used. A combination of different acid-base indicators can be used to produce different colored inks. For example an indicator that is red when combined with an indicator that is blue can make an ink that is purple. Different indicators may also be used to optimize the time for self-erasing since they become colorless at different pH levels. Lower concentrations of indicators decrease the color intensity and decrease the time in which self-erasing occurs. Higher concentrations of indicators increase the color intensity and delay the self-erasing. Furthermore a self-erasing ink containing multiple acid-base indicators can appear as a first color initially and a second color after a certain period of time. The change to the second color can be useful as a signal that the ink was in the process of self-erasing.

In one embodiment the indicator can be thymolphthalein which produces a blue ink. Other suitable indicators include but are not limited to phenolphthalein, p-cresolphthalein and o-cresolphthalein which produce red inks, and p-naphtholbenzein, quinoline blue, tetrabromophenoltetraiodophthalein, tetraiodophenoltetraiodophthalein, phenoltetraiodophthalein, ethyl-bis(2.4-dimethylphenyl)acetate, thymoltetrachlorophthalein, and xylenolphthalein which produce a blue ink. Additional suitable indicators include Pinachrome (p-ethoxyquinaldine-p-et hoxyquionoline-ethylcyanine) which produces a purple ink, nitramine which produces a reddish brown ink, 2,4,6-trinitrotoluene, 1,3,5-trinitrobenzene, and sodium trinitrobenzoate which produce orange inks, m-nitrophenol, p-hydroxybenzylglucosinolate, m-dinitrobenzoylene urea, o-nitrophenol, and p-nitrophenol which produce yellow inks, and alpha-naphtholphthalein which produces a red or blue-green ink depending on the pH.

It is to be understood that the colors of the aforementioned indicators are approximate and the color of the self-erasing ink will depend on the interaction of all its components. In addition it is to be understood that indicators other than those enumerated may be used. Furthermore although the enumerated indicators all have a colorless state which corresponds to the self-erased state of the ink, an ink can also be considered self-erasing if the indicator were the same color as the paper. For example on yellow paper an indicator that is blue in the presence of a base but yellow when the base is removed can be used in a self-erasing ink specific to that color paper.

The base or bases of the self-erasing ink comprises 0.05% to 35% of the ink by weight. Inks with less than 0.05% base by weight may not be sufficiently colored or may self-erase too quickly. Inks with over 35% base by weight may prove insoluble or impractical to formulate as a liquid ink compatible with printer technology. The amount of base required also depends on the particular base used, as some are stronger than others. Bases may be used in combination in the self-erasing ink. Bases may also increase the solubility of the acid-base indicator, allowing a greater concentration of indicator to be used in the ink.

In one embodiment the base of the self-erasing ink is sodium hydroxide. Other bases include but are not limited to ammonia, ammonia sodium acetate, ammonium carbonate, amylamine, barbital sodium, barium hydroxide, borax, calcium carbonate, calcium hydroxide, diethanolamine, diethylamine, diisopropanolamine, di-n-butylethanolamine, dipropylamine, ethylmonoethanolamine, ferrous hydroxide, lithium hydroxide, magnesia, monoethanolamine, monoisopropanolamine, morpholine, n-butyldiethanolamine, potassium acetate, potassium bicarbonate, potassium carbonate, potassium cyanide, potassium hydrogen phosphate, potassium hydroxide, potassium sulfite, sodium acetate, sodium benzoate, sodium bicarbonate, sodium carbonate, sodium hydrogen phosphate, sodium metasilicate, sodium phosphate, sodium sesquicarbonate, sodium sulfite, triethanolamine, triethylamin, triisopropanolamine, trisodium phosphate, and the like.

The surfactant or surfactants which give the self-erasing ink desired flow and wetting characteristics comprise 0.05% to 10% of the ink by weight. An additional function of the surfactant is to increase the solubility of the acid-base indicator, allowing a greater concentration of indicator to be used in the ink. A further function may include decreasing the rate of evaporation of the solvent.

Example surfactants include t-octylphenoxypolyethoxyethanol, sodium lauryl sulfate, ammonium lauryl sulfate, sodium c14-16 olefin sulfonate, 2-heptadecenyl-hydroxyethylimidazoline, acetic acid salts of laurylamine, acetylene alcohols, acetylene glycols, acetylenic alcohol, acetylenic glycol, acylated peptide, aliphatic amine salts, aliphatic quaternary ammonium salts, alkyl naphthalene sulfonate, alkyl sulfonate, alkylamine oxide, alkylbenzene sulfonate, alkylether phosphate, alkylether sulfate, alkylphosphate, alkylsulfoacetate, aminocarboxylate, benzalkonium chloride, benzalkonium salts, benzethonium chloride, benzyltributylammonium chloride, carboxybetaine, cetylpyridinium bromide, cetylpyridinium chloride, cetyltrimethylammonium chloride, coconut amine, dialkyl sulfocuccinate, dihydroxyethylstearylamine, fatty acid alkanolamine, fatty acid alkylolamide sulfate, fatty acid monoglyceride, fatty-acid soaps, hardened castor oil, higher alcohol sulfates, higher secondary alcohol ethoxy sulfates, higher secondary alcohol sulfates, hydrochloric acid salts, imidazolium salts, imidazoliumbetaine, lauryldihydroxyethylbetaine, lauryltrimethylammonium chloride, monoglysulfate, n-acyl-n-methyl-beta-alaninate, n-acyl-n-methylglycinate, n-acylmethyltaurine, n-glutamate, nonyphenyls, polyethylene glycol fatty acid ester, polyglycerin fatty acid ester, polyoxyethylene, polyoxyethylene alkyl esters, polyoxyethylene alkyl ethers, polyoxyethylene alkyl phenyl ether, polyoxyethylene alkyl phenyl ether sulfate, polyoxyethylene alkylamine, polyoxyethylene castor oil, polyoxyethylene fatty acid amides, polyoxyethylene glycerin fatty acid ester, polyoxyethylene lanolin derivatives, polyoxyethylene polyoxypropylene alkylether, polyoxyethylene secondary alcohol ether, polyoxyethylene sorbitol fatty acid ester, polyoxyethylene sterol ether, propylene glycol fatty acid ester, pyridinium salts, rosin amine, sodium sulfonate, sorbitan fatty acid ester, stearyidimethylbetaine, stearylamine, sucrose fatty acid ester, sulfobetaine, sulfonated oil, alpha-olefin sulfonate, and the like.

The self-erasing ink may contain other additives to optimize its properties. Such additives include but are not limited to viscosity modifiers, pH adjustors, preservatives, antioxidants, flame retardants, evaporation accelerators, evaporation inhibitor, corrosion inhibitors, humectants, buffers, bleed control agents, sequestering agents and metal chelators, lubricants, fillers, antiseptics, solubility promoters, biocides, fungicides, and other anti-microbial agents, fixatives, penetrants, binders, surface tension regulators, and the like.

A component of the self-erasing ink may serve several different functions. For example the same chemical can serve as both a solvent and a lubricant. Another chemical may serve as a solubility promoter, a surfactant, and an evaporation inhibitor.

It is to be understood that the aforementioned systems, methods, and compositions are merely exemplary and not scope limitations.

EXAMPLES

In the following examples, the system and method of self-erasing printing will be clarified further by examples thereof. However, it is to be understood that the following are only exemplary or illustrative. Numerous modifications and alternative compositions, methods, and systems may be devised by those skilled in the art. The appended claims are intended to cover such modifications and alternatives.

Example 1

A 0.3% by weight solution of sodium hydroxide was prepared by dissolving sodium hydroxide pellets in reverse-osmosis filtered water. Thymolphthalein indicator was added to the solution to the point of saturation. The solution was filtered to remove undissolved thymolphthalein. A mixed surfactant solution was added in an amount less than 1% of the total solution by weight.

The resulting blue ink was injected into a #2 cartridge manufactured by the Lexmark Corporation. The cartridge was loaded into a LEXMARK [trade] model X2480 printer. Text and photographic images were printed over the course of several days on GEORGIA-PACIFIC [trade] Copy Paper, 88 brightness, 104 whiteness, 20 pound weight. The printed images were clearly visible and easily read when examined 2.5 hours after printing. When examined 5 hours after printing the images were visible but faint. When examined 16 hours after printing the images had completely self-erased.

The paper from the self-erased hardcopies was subsequently re-printed in the same manner and performed as it had originally.

Example 2

Sodium hydroxide was dissolved in 15 mL of reverse-osmosis filtered water to form a 1.5% solution by weight. A prepared surfactant solution was added at a quantity of 0.15% by weight. The surfactant solution contained magnesium isododecylbenzenesulfonate, ammonium C12-15 pareth sulfate, sodium dodecylbenzenesulfonate, SD alcohol 3-A, sodium xylenesulfonate, lauramidopropylamine oxide, magnesium sulfate, DMDM hydantoin, pentasodium pentetate, sodium bisulfate, methylchloroisothiazolinone, and methylisothiazolinone in water. The surfactant solution served both to improve the flow of the ink and to increase the solubility of the acid-base indicator.

Phenolphthalein indicator was added to the solution at 1.4% by weight. The resulting red ink was injected into a cartridge. The cartridge was loaded into a model CX7450 printer manufactured by EPSON [trade] Corporation. Text and photographic images were printed on SOUTHWORTH [trade] 100% cotton fiber, bond finish, 20 pound paper. The printed images were clearly visible and easily read at the time of printing and remained substantially readable for several days. When the stack of pages was examined 12 days after printing all images had self-erased including those on the top, middle, and bottom of the stack.

What is claimed is:

1. A self-erasing inkjet ink enabling paper re-use comprising:

a primary solvent of water, a base dissolved in said water to form an alkaline solution, and an acid-base indicator soluble in said alkaline solution and having color in the presence of said base, wherein said ink is initially visible when printed on ordinary paper, and wherein said ink becomes invisible through chemical reaction with carbon dioxide in the air, whereby said paper may be reused.

2. The ink of claim 1 wherein said base comprises sodium hydroxide.

3. The ink of claim 1 wherein said base comprises potassium hydroxide.

4. The ink of claim 1 wherein said acid-base indicator is of the phthalein, nitro, or quinolone series.

5. The ink of claim 1 wherein said acid-base indicator comprises thymolphthalein.

6. The ink of claim 1 wherein said ink comprises a surfactant.

7. The ink of claim 1 wherein said ink comprises a plurality of solvents.

8. A method of paper re-use comprising:

(a) providing an ink comprising a primary solvent of water, a base dissolved in said water to form an alkaline solution, and an acid-base indicator soluble in said alkaline solution wherein said indicator is colored in the presence of said base, (b) inkjet printing of said ink onto ordinary paper to form a visible image, (c) self-erasure of said ink through chemical reaction with carbon dioxide in the air, whereby the image printed on said paper becomes invisible, and (d) re-use of said paper.

* * * * *